US011013305B2

(12) United States Patent
Jackson et al.

(10) Patent No.: US 11,013,305 B2
(45) Date of Patent: May 25, 2021

(54) LUGGAGE COMPRESSION PANEL, SUITCASE AND CARRYING SYSTEM COMPRISING A LUGGAGE COMPRESSION PANEL

(71) Applicant: Thule, Inc., Seymour, CT (US)

(72) Inventors: Graham Jackson, Boulder, CO (US); Mark Thibadeau, Boulder, CO (US)

(73) Assignee: Thule Sweden AB, Hillerstorp (SE)

( * ) Notice: Subject to any disclaimer, the term of this patent is extended or adjusted under 35 U.S.C. 154(b) by 138 days.

(21) Appl. No.: 15/605,285

(22) Filed: May 25, 2017

(65) Prior Publication Data

US 2017/0347765 A1 Dec. 7, 2017

Related U.S. Application Data

(60) Provisional application No. 62/344,229, filed on Jun. 1, 2016.

(51) Int. Cl.

| | |
|---|---|
| ***A45C 13/02*** | (2006.01) |
| ***A45C 5/03*** | (2006.01) |
| ***A45C 5/14*** | (2006.01) |

(52) U.S. Cl.

CPC ..... *A45C 13/02* (2013.01); *A45C 5/03* (2013.01); *A45C 5/14* (2013.01); *A45C 2013/026* (2013.01)

(58) Field of Classification Search

CPC ..... A45C 13/385; A45C 3/004; A45C 5/14; A45C 13/02; A45C 13/262; A45C 5/146

USPC ..... 190/18 A, 18 R, 110

See application file for complete search history.

(56) References Cited

U.S. PATENT DOCUMENTS 654,267 A * 7/1900 Mieden ..... A45C 13/03 206/289
775,343 A * 5/1901 Anderson ..... A45C 13/02 190/36
2,362,807 A * 11/1944 Dresner ..... A45C 13/03 190/110
2,536,169 A * 1/1951 Gray ..... A45C 3/00 190/103
2,738,041 A * 3/1956 Mount Haes ..... A45C 5/03 190/111
2,856,110 A * 10/1958 Cowan ..... A45C 13/03 223/89
2,873,830 A * 2/1959 Wilt ..... A45C 13/03 190/109
2,937,728 A * 5/1960 Koffler ..... A45C 3/12 190/110
3,263,779 A * 8/1966 Bialer ..... A45C 13/02 190/110

(Continued)

FOREIGN PATENT DOCUMENTS

CA 2635328 C * 8/2016 ..... A45C 13/02
DE 102011120833 A1 * 6/2013 ..... A45C 13/02

(Continued)

*Primary Examiner* — Tri M Mai

(74) *Attorney, Agent, or Firm* — Sterne, Kessler, Goldstein & Fox P.L.L.C.

(57) ABSTRACT

A luggage compression panel for compressing items accommodated in an interior space of luggage. The luggage compression panel includes, but is not limited to, a supporting structure defining a supporting area, and at least one locking mechanism for releasably fixing an engaging member of the luggage on the supporting structure.

20 Claims, 3 Drawing Sheets

(56) References Cited

U.S. PATENT DOCUMENTS 4,074,839 A * 2/1978 Wood ..... A45F 3/08 224/635
4,844,214 A * 7/1989 Castelli ..... A44B 11/20 190/103
4,854,602 A * 8/1989 Takeuchi ..... A45C 5/02 280/79.11
5,219,423 A * 6/1993 Kamaya ..... A45C 7/0086 224/583
5,524,754 A * 6/1996 Hollingsworth ..... G06F 1/1628 190/111
5,826,771 A * 10/1998 Peng ..... A45F 3/04 224/651
6,105,764 A * 8/2000 Scicluna ..... A45C 13/02 190/111
6,148,973 A * 11/2000 Chang ..... A45C 5/14 190/115
6,175,994 B1 * 1/2001 Nicoletti ..... A43C 11/1413 24/68 SK
6,325,189 B1 * 12/2001 King ..... A45C 3/001 190/119
6,435,324 B1 * 8/2002 Hoberman ..... A45C 13/02 190/110
6,487,761 B2 * 12/2002 Van Tassel ..... A44B 11/266 24/606
6,502,677 B1 * 1/2003 Tiramani ..... A45C 5/03 16/114.1
8,376,102 B2 * 2/2013 Ritschel ..... A45C 13/03 150/127
8,424,169 B2 * 4/2013 Gammell ..... A43C 1/00 24/115 G
2002/0027052 A1 * 3/2002 Godshaw ..... A45C 5/14 190/111
2017/0360165 A1 * 12/2017 Hamaty ..... A45C 9/00

FOREIGN PATENT DOCUMENTS

EP 0530067 A1 3/1993
FR 2698526 A1 * 6/1994 ..... A44B 11/26

* cited by examiner

LUGGAGE COMPRESSION PANEL, SUITCASE AND CARRYING SYSTEM COMPRISING A LUGGAGE COMPRESSION PANEL

CROSS REFERENCE TO RELATED APPLICATION

This application claims priority to U.S. Provisional Application No. 62/344,229, filed Jun. 1, 2016, which is hereby incorporated herein in its entirety by reference.

TECHNICAL FIELD

The technical field relates to a luggage compression panel for compressing items accommodated in an interior space of luggage. In addition, the technical field relates to a suitcase usable with a luggage compression panel and to a carrying system comprising a luggage compression panel.

BACKGROUND

Packing luggage is often a cumbersome task as space within the luggage is limited and in a lot of situations is too little for storing items such as clothes. In such cases, the user often tends to stack clothes beyond the available height of an interior compartment of the luggage and compresses the content using e.g. the lid of a piece of luggage in order to be able to close a closure means of the luggage like a zipper or other closure mechanisms. This has the drawback that a restoring force is generated in the inside of the luggage by the stack of clothes which presses against the lid and exerts an adverse force on the closure mechanism which could damage the same.

On the other hand, it is possible that the space inside the luggage is overdimensioned for a specific use leading to a situation in which the items accommodated in the luggage do not completely fill the interior compartment of the luggage. In this case, clothes or other items tend to move inside the luggage during transport which may lead to creases in the clothes.

Accordingly, it is desirable to at least address the foregoing. In addition, other desirable features and characteristics will become apparent from the subsequent summary and detailed description, and the appended claims, taken in conjunction with the accompanying drawings and this background.

SUMMARY

Described in a first embodiment is a luggage compression panel for compressing items accommodated in an interior space of luggage. The luggage can be a suitcase, for instance. The compression panel comprises a supporting structure defining a supporting area, and at least one locking mechanism for releasably fixing an engaging member of said luggage on said supporting structure.

In the context of the present disclosure, a supporting structure can be any suitable means which is able to define a supporting area. Accordingly, the supporting structure can for example comprise a board like structure, a frame like structure or a frame which is able to receive and withstand loads exerted thereon. For that, the supporting structure can comprise a rigid material or can be formed as a rigid structure by a suitable geometrical construction. In this connection, it is possible to employ suitable reinforcements or reinforcing structures as known from lightweight constructions. The supporting structure can additionally comprise sections made from a more flexible material such as a fabric spanned over rigid elements of the supporting structure. Thus, the supporting structure can comprise a base frame substantially forming an outer limit of the supporting structure and a fabric provided on the frame and extending over an interior space formed within the frame. The frame as well as the fabric can be formed and arranged such that they substantially extend in a plane. In other words, the supporting structure is advantageously formed in a plane and consequently can have a two-dimensional extension. The supporting area as formed by the supporting structure can be designed and used to contact items to be accommodated in the luggage.

The fabric may comprise a mesh-like structure or at least comprise a mesh portion. Alternatively, the fabric can comprise a liner or a combination of a liner and a mesh. Furthermore, the fabric can comprise two fabric portions arranged on each other thereby forming a usable space between both fabric portions. The space can be accessible by means of a zipper provided in one fabric. The frame can be an integrally formed element or can comprise multiple frame elements joined to form the frame. For example, the frame can comprise two frame elements which are joined to each other using suitably constructed locking mechanisms which simultaneously form coupling elements. Also, it is possible to form the frame elements from straight sections which are coupled to each other with corner connectors. The frame elements can comprise different shapes and forms including, but not limited to, hollow structures like tubes having round or rectangular cross section, fiber glass rods or aluminum rods or combinations of such structures.

On at least one side of the fabric, at least one webbing may be provided for providing extra structure to construction. The webbing can be used to relief the fabric from pressing forces so that the fabric is not deformed when items are compressed with the compression panel or is at least not deformed to a great extent when items are compressed so that a pocket or interior space provided in the fabric is usable in all conditions. The webbing can be fixed to the frame of the supporting structure on opposite side. Furthermore, multiple webbings can be used. Advantageously, the webbings are arranged so as to extend in parallel to the fabric. Furthermore, it is beneficial if at least two webbings are arranged such that they cross each other. The webbing or webbings is/are preferably arranged on a side of the compression panel which makes contact with the items to be accommodated or compressed in the luggage.

The locking mechanism is adapted to releasably fix an engaging member of the luggage on the supporting structure. Thus, the locking mechanism may provide a secure connection between the engaging member of the luggage and the supporting structure allowing for the transmission of a force from the supporting structure to the engaging member. Advantageously, the fixation or secure connection between the engaging member and the supporting structure which is achieved by the locking mechanism prevents a movement of the supporting structure with respect to the engaging member in at least one direction. The locking mechanism can be of different kinds involving mechanisms which force transmittingly engage with the engaging member by positive fit or frictional fit, for instance.

In one embodiment, the locking mechanism may be adapted to provide a frictional connection, in particular a form-fit engagement, with the engaging member. A frictional connection can be achieved by suitably clamping the engaging member with respect to the supporting structure. A form-fit engagement can be achieved either by an engagement of the engaging member with the locking mechanism or an element of the locking mechanism or by an engagement of an element of the locking mechanism with the engaging member. An engagement can be achieved by providing two mating members, e.g. a protrusion and a recess, which can be engaged in a plug and socket type way, for instance.

According to a further embodiment, the locking mechanism may comprise a receiving portion for receiving said engaging member, the receiving portion having a supporting surface, and a latching member arranged movable towards and away from said supporting surface, the latching member being preferably pretensioned towards said supporting surface by means of a biasing means.

The receiving portion may be formed such that an end of an engaging portion can be passed therethrough. Preferably, the receiving portion is formed loop like and comprises a U-shape wherein the free ends of both legs of the U-shape are coupled to a base portion of the locking mechanism. The supporting surface may be formed on the inside of the receiving portion such that it faces the base portion.

The latching member can be a locking plate. In a further embodiment, the latching member can be at least partially translatory movably arranged in the receiving portion.

According to another embodiment, the latching member can be guided in two guiding grooves formed in the receiving portion on opposite sides of the latching member. In a further advantageous embodiment, the guiding grooves are substantially straight.

According to a further embodiment of the present disclosure, the latching member can comprise an opening for mounting a gripping element, preferably a strap or pull tab, to the latching member such that the latching member is movable into a released position by pulling the gripping element.

Alternatively, the latching member can be realized in the form of a pump buckle allowing to apply a tensioning force on the engaging member by a pumping movement in order to press the compression panel against items to be accommodated.

In a further embodiment, the engaging member may comprise engaging grooves and may be mountable to a supporting structure of said luggage, preferably to a luggage chassis, at one end and may be insertable into the receiving portion at its other end wherein the latching member may be adapted to engage with the grooves of the engaging member.

A further embodiment provides a suitcase comprising a base portion defining an interior space for accommodating items to be transported, the base portion preferably forming a first outer shell portion of the suitcase, and at least one engaging member mounted in the base portion and adapted to be coupled to a luggage compression panel.

According to an exemplary embodiment, the engaging member may comprise engaging recesses, e.g. engaging grooves. Preferably, the engaging members are formed as ratchet straps.

In one embodiment, the engaging member may comprise a toothed portion. The toothed portion may comprise multiple teeth comprising tooth flanks with an inclined surface and a vertical surface wherein the vertical surface on each tooth is arranged on an engaging side of the tooth. Engaging side of a tooth is to be understood as the side of the tooth which is oriented towards a fixing portion of the engaging member at which the engaging member is fixed on a piece of luggage, such as a suitcase.

In a further embodiment, the engaging member can be made of plastics.

According to another embodiment, the suitcase may further comprise a supporting device mounted on the base portion, wherein at least one of the at least one engaging members is mounted on the supporting device.

In one embodiment, the supporting device may comprise a rigid pan portion for at least partially stiffening the base portion, in particular in a mounting area of wheels, wherein one of the at least one engaging members is mounted on the rigid pan portion.

In a further embodiment, the supporting device may further comprise a handle reinforcement portion for accommodating a telescopable handle of the suitcase, wherein one of the at least one engaging members is mounted on the handle reinforcement portion.

In another embodiment, a carrying system is provided having a suitcase comprising a base portion defining an interior space for accommodating items to be transported, the base portion preferably forming a first outer shell portion of the suitcase, at least one engaging member mounted in the base portion and adapted to be coupled to a luggage compression panel, and a luggage compression panel for compressing items accommodated in the interior space of the suitcase, the compression panel comprising a supporting structure defining a supporting area, and at least one locking mechanism for releasably fixing the engaging member of the luggage on the supporting structure.

Additional features and advantages may be gleaned by the person skilled in the art from the following description of exemplary embodiments, which are not to be construed as limiting, however, drawing reference to the attached drawings.

BRIEF DESCRIPTION OF THE DRAWINGS

The present invention will hereinafter be described in conjunction with the following drawing figures, wherein like numerals denote like elements, and.

All figures are only schematic depictions of exemplary embodiments in which, in particular, distances and dimensional correlations are not presented to scale.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
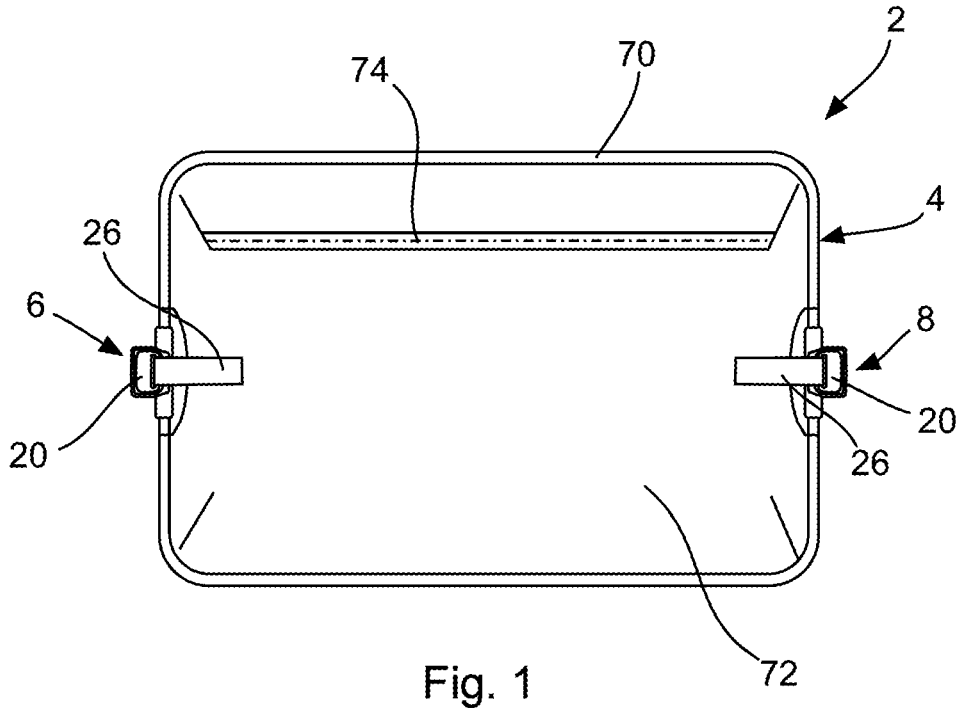
FIG. 1 shows a plan view of a luggage compression panel according to an exemplary embodiment.

FIG. 1 shows a schematic plan view of a luggage compression panel for compressing items accommodated in an interior space of luggage according to an exemplary embodiment. The luggage compression panel 2 comprises a supporting structure 4 including, but not limited to, a frame 70 and a fabric 72 mounted or spanned on the frame 70. The fabric is partially wound about sections of the frame 70 and fixed to the same by sewing a reverted portion of the fabric 72 with another portion of the fabric 72 along the frame 70.

In other words, portions of the fabric 72 are reverted and sewn such that channels are formed in which portions of the frame 70 are accommodated. In this way, the fabric is fixed on the frame under tension such that the fabric extends substantially in a two-dimensional manner within the frame.

In the embodiment as shown in FIG. 1, the fabric 72 is structured in a double-layer manner meaning that two fabric layers are arranged on each other thereby forming an interior space between the same which can be used as compartment for stowing items. For that, a zipper 74 is provided by means of which access to the compartment is selectively possible.

The frame 70 can be formed integrally or may be formed from multiple frame sections. In the embodiment as shown in FIG. 1, the frame is built from two frame sections which are coupled to each other by means of locking mechanisms 6, 8. One frame section is shown in the upper half of FIG. 1 and one frame section is shown in the lower half of FIG. 1 wherein each frame section comprises a U-shape with their free ends coupled to each other by means of the locking mechanisms 6, 8. In the embodiment, aluminum is used for the frame elements but other materials, preferably light-weight materials, may be used instead.

On opposite sides of the support structure 4, locking mechanisms 6, 8 are provided for an engagement with an engagement member of luggage. The locking mechanisms comprise similar components and are inversely arranged on the support structure. The detailed construction of the locking mechanisms 6, 8 is explained in the following with reference to FIG. 3.

Figure 3:
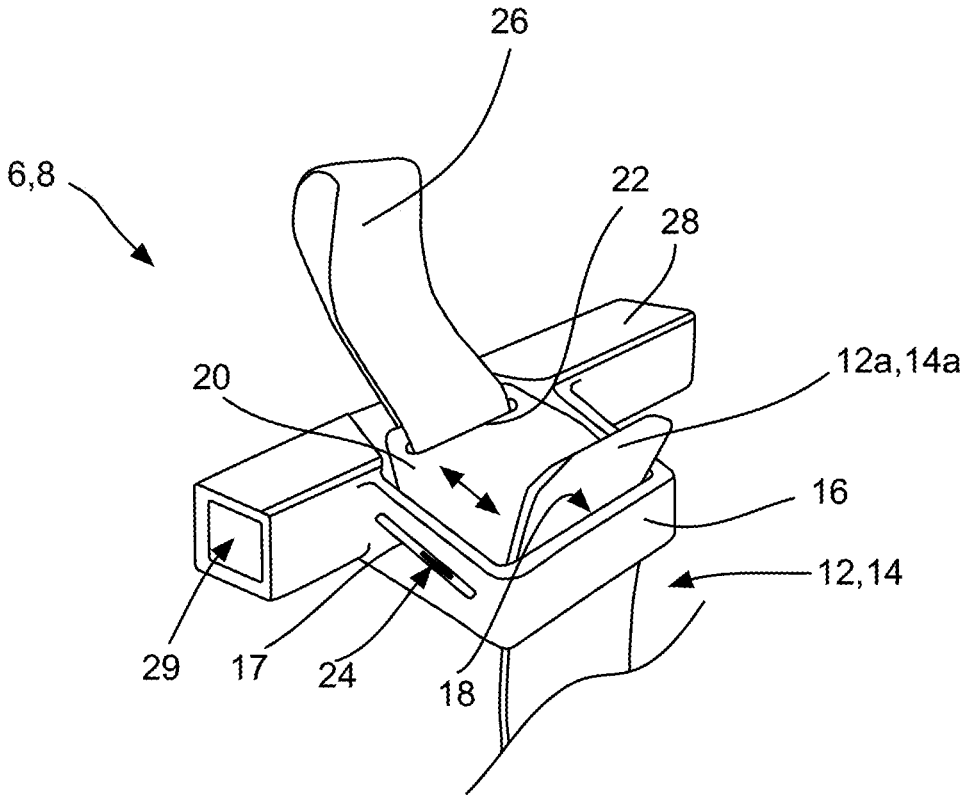
FIG. 3 shows a locking mechanism of a luggage compression panel according to an exemplary embodiment.
Figure 4:
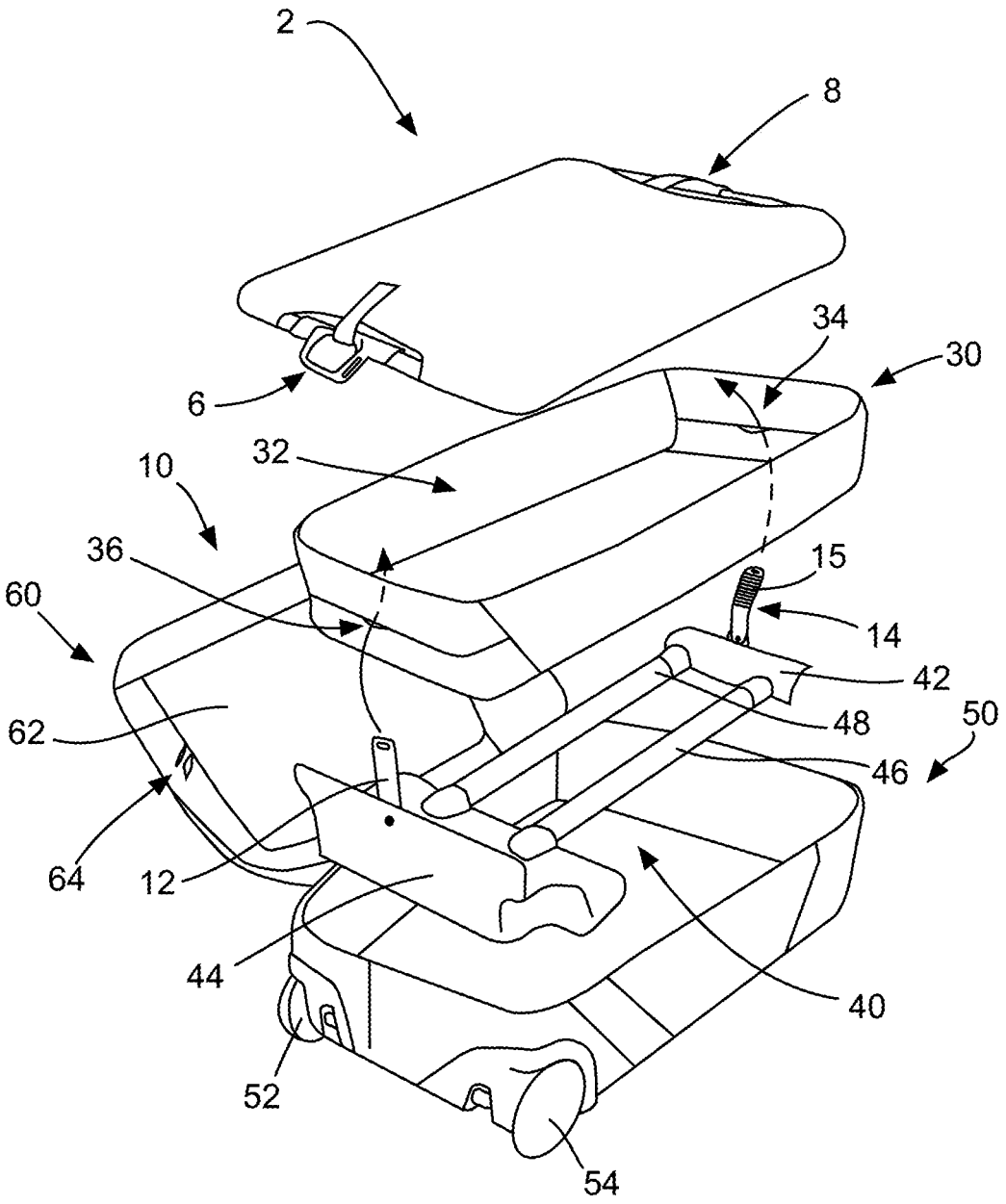
FIG. 4 shows an exploded view of a carrying system according to an exemplary embodiment.

FIG. 3 shows a perspective schematic view of one locking mechanism 6, 8. The locking mechanism 6, 8 are adapted to receive an engaging member 12, 14 of luggage, e.g. a suitcase as shown in FIG. 4, and to releasably lock a movement of the engaging member with respect to the locking mechanism. The locking mechanism 6, 8 comprises a base portion 28 being formed so as to comprise a hollow interior section 29 for accommodating end portions of frame elements of the support structure 4. In FIG. 3, the hollow interior section 29 is adapted to the shape of the frame element to be coupled thereto and in the exemplary case has a square shape. In this way, a non-rotating connection between the frame element and the locking mechanism can be achieved providing an enhance force transmission.

In the middle section of the base portion 28, a receiving portion 16 is formed for receiving an engaging member 12, 14. FIG. 3 shows a state in which an end 12*a*, 14*a* of the engaging member 12, 14 is passed through the receiving portion 16. The receiving portion 16 is formed loop like and comprises a U-shape the free ends of both legs of which being coupled to the base portion 28. On the inside of the receiving portion 16, a supporting surface 18 is provided which faces the base portion 28. This supporting surface 18 is provided for forming an abutment portion against which the engaging member 12, 14 inserted in the receiving portion 16 can be supported. The surface of the engaging member 12, 14 facing the supporting surface 18 as well as the supporting surface are substantially smooth so that there is no considerable friction between these surfaces. This allows an easy insertion of the engaging member 12, 14 into the receiving portion 16.

The locking mechanism 6, 8 further comprises a latching member in the form of a locking plate 20 which is translatory movably arranged with respect to the supporting surface 18. For that, guiding portions 24 arranged on opposite sides of the locking plate 20 are slidably guided in substantially straight guiding grooves 17 formed in the legs of the receiving portion 16. In the guiding grooves 17, a biasing means in the form of a spring (not shown) is arranged for biasing the latching plate 20 towards the supporting surface 18. Consequently, if no counter force is applied on the latching plate 20, the latching plate 20 is moved towards the supporting surface 18 until it abuts the same. Consequently, in case the engaging member 12, 14 is inserted in the receiving portion 16, the latching plate 20 abuts against a side of the engaging member 12, 14 which is opposite to the side facing the supporting surface 18. By this, the engaging member is pressed against the supporting surface 18 by means of the latching plate 20.

As is shown in FIG. 4, the engaging members 12, 14 comprise engaging grooves 15 and are formed as ratchet straps. The latching plate 20 is formed such that its front end or edge facing the supporting surface 18 is able to engage with the engaging grooves 15. Depending on the shape of the grooves provided in the engaging members, a movement of the engaging members 12, 14 with respect to the latching plate 20 is prevented. In this embodiment, the engaging grooves 15 are formed in the shape of ratchet teeth each of which comprising tooth flanks with an inclined surface and a vertical surface wherein the teeth are formed such that the vertical surfaces are arranged on the lower sides of the teeth in FIGS. 3 and 4 and the inclined surfaces are arranged on the upper sides. By this, pushing the engaging members into the receiving portions from below or pushing the compression panel 2 on the engaging members 12, 14 from above is possible because the inclined surface of the teeth will push the locking plate 20 in a direction against the biasing force. In other words, with this configuration, the locking mechanism acts in only one direction in that a movement of the compression panel in the upward direction in FIGS. 3 and 4 is not possible and a movement in the opposite direction is allowed. In this way, a user can push the compression panel onto the items to be accommodated in the piece of luggage and the locking mechanisms 6, 8 or rather the locking plates 20 of the same will ride over the teeth of the engaging members 12, 14.

On the other hand, the locking mechanisms 6, 8 prevent a movement in the opposite direction so that a compressed state is maintained. In order to release the locking of the locking mechanisms 6, 8, the locking plate 20 comprises an opening 22 by means of which a gripping element or pull tabs in the form of a textile loop 26 is fixed. A user can use this textile loop 26 for pulling the locking plate 20 in a direction against the biasing force and away from the engaging members 12, 14 so that an engagement between the locking plate 20 and the engaging grooves 15 or teeth is released and the compression panel can be removed from the engaging members 12, 14.

Figure 2:
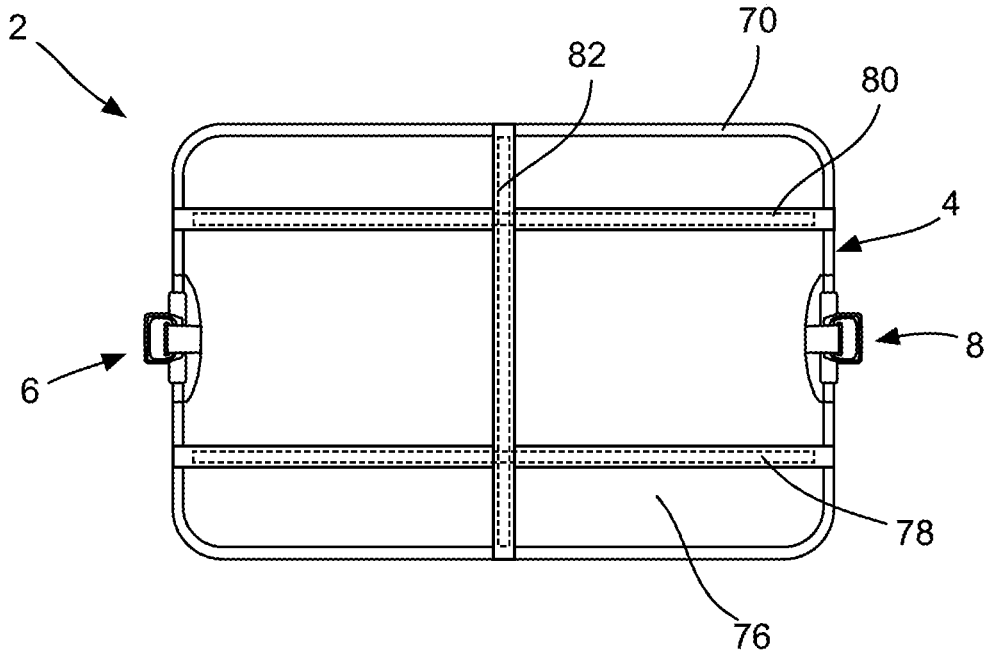
FIG. 2 shows a plan view of a luggage compression panel according to a further exemplary embodiment.

FIG. 2 shows a further embodiment of a compression panel 2. In this embodiment, webbings 78, 80, 82 are spanned on the frame 70. These webbings 78, 80, 82 add additional structure to the compression panel in that they prevent a deformation of a fabric 72 to a great extent. The webbings 78, 80, 82 are provided on a side of the compression panel which faces the items to be compressed in luggage. The webbings 78, 80, 82 are stitched to the liner 76 in a way as depicted by the dashed lines in FIG. 2. As material for the webbings 78, 80, 82, a fabric being thicker than the liner material is used in order to provide additional stability. It is noted that the structure as shown in FIG. 2 may form the opposite side of the compression panel 2 as shown in FIG. 1. By this, a use of above described compartment in the compression panel 2 can still be used in a compressed state in which the compression panel presses against the items to be accommodated in the piece of luggage. It is noted that the compartment as described here is formed between the fabric 72 and the liner 76.

FIG. 4 shows an exploded view of a carrying system according to an exemplary embodiment. The carrying system 10 comprises a suitcase 10 and a compression panel 2 as described before. The suitcase 10 comprises a base portion 50 defining an interior space for accommodating items to be transported therein. In this embodiment, the base portion 50 forms an outer shell of the suitcase 10. The base portion 50 comprises a mounting area of wheels 52, 54. Furthermore, the suitcase 10 comprises a supporting device 40 which renders the base portion more rigid and allows to use a comparatively soft material for the outer shell. The supporting device 40 comprises a rigid pan portion 44 for stiffening the base portion in the mounting area of wheels 52, 54. Furthermore, the supporting device 40 comprises a handle reinforcement portion 42 for accommodating a telescopable handle of the suitcase. The handle reinforcement portion is coupled to the rigid pan portion 44 by means of parallel tubes 46, 48 in each of which a telescopable bar coupled to the handle can be slidably accommodated. On the pan portion, engaging member 12 is fixed whereas on the handle reinforcement portion 42 engaging member 14 is fixed. In the present embodiment, one end of the engaging members 12, 14 is riveted to the respective portions of the supporting device 40. The free ends 12*a*, 14*a* of both engaging members are oriented away from the base portion 50. The supporting device 40 is fixed on the base portion 50 on a side forming the rear side wall of the suitcase and such that at least the handle accommodated in the handle receiving portion is accessible from the rear side of the suitcase. Accordingly, the supporting device 40 forms an interior chassis of the suitcase 10.

Pivotably arranged and coupled to the base portion 50 is a lid 60 of the suitcase 10. The lid 60 comprises an interior pocket 62 which is accessible via a zipper 64. In the present embodiment, the lid is also closable on the base portion 50 by means of a zipper (not shown).

An inner liner bag 30 forming an interior space 32 for accommodating items to be transported in the suitcase is provided in the base portion 50 such that the supporting device 40 is covered by the same. The inner liner bag 30 comprises two opening 34, 36 at positions which allow to pass the engaging members 12, 14 therethrough.

The compression panel 2 is adapted to the shape of the inner liner bag 30. In order to compress items, particularly clothes, accommodated in the liner bag 30, the engaging members 12, 14 protruding from the openings 34, 36 are first inserted into the locking mechanisms 6, 8 of the compression panel 2. Subsequently, the compression panel is pushed towards the items accommodated in the liner bag 30 by the user in order to compress them. The interaction between the locking mechanisms 6, 8 and the engaging members 12, 14 leads to a condition in which the compression panel 2 remains pressed against the items even if the user stops exerting a pushing force on the compression panel 2. In this way, the items are compressed and securely stowed in the suitcase. In order to remove the compression panel and get access to the items, the user can pull the pull tabs 26 thereby releasing the engagement of the locking mechanisms 6, 8.

In conclusion, it is pointed out that terms like "comprising" or the like are not intended to rule out the provision of additional elements or steps. Let it further be noted that "a" or "an" do not preclude a plurality. In addition, features described in conjunction with the different embodiments can be combined with each other however desired. It is also noted that the reference numbers in the claims are not to be construed as limiting the scope of the claims. Moreover, while at least one exemplary embodiment has been presented in the foregoing summary and detailed description, it should be appreciated that a vast number of variations exist.

It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A luggage compression panel for compressing items in an interior space of a suitcase, the luggage compression panel comprising:

a single supporting structure defining a supporting area;

a first locking mechanism integral with a first end of the single supporting structure for releasably fixing a first engaging member of the suitcase; and a second locking mechanism integral with a second end of the single supporting structure, opposite the first end, for releasably fixing a second engaging member of the suitcase, wherein the first locking mechanism is adapted to provide a first frictional connection with the first engaging member, wherein the second locking mechanism is adapted to provide a second frictional connection with the second engaging member, wherein the first engaging member is insertable through a first receiving portion of the first locking mechanism, wherein the second engaging member is insertable through a second receiving portion of the second locking mechanism, wherein the single supporting structure is releasably coupled to the first and second engaging members, wherein the single supporting structure comprises:

a rigid frame integral with the first and second receiving portions of the first and second locking mechanisms and defining an outer boundary of the single supporting structure; and a flexible fabric coupled to the rigid frame and extending within the outer boundary, wherein the first and second engaging members extend through the luggage compression panel within an outer perimeter of the luggage compression panel, wherein the first and second receiving portions each comprise a loop coupled to the rigid frame, and wherein the first and second locking mechanisms each comprise a locking plate that restricts movement of the single supporting structure in a first direction away from the items and allows movement of the single supporting structure in a second direction towards the items when the first and second engaging members are inserted through the first and second receiving portions of the first and second locking mechanisms.

2. The luggage compression panel of claim 1, wherein the first and second frictional connections are form-fit engagements.

3. The luggage compression panel of claim 1, wherein the first and second locking mechanisms each comprise a supporting surface on an inside of the loop that faces the rigid frame, the locking plate adapted to move towards and away from the supporting surface.

4. The luggage compression panel of claim 3, wherein the locking plate is at least partially translatory movably arranged in the receiving portion.

5. The luggage compression panel of claim 4, wherein the locking plate is guided in two guiding grooves formed in the receiving portion on opposite sides of the locking plate.

6. The luggage compression panel of claim 5, wherein the guiding grooves are straight.

7. The luggage compression panel of claim 4, wherein the locking plate comprises an opening for mounting a gripping element to the locking plate such that the locking plate is movable into a released position by pulling the gripping element.

8. The luggage compression panel of claim 7, wherein the gripping element is a strap.

9. The luggage compression panel of claim 3, wherein the first and second engaging members comprise grooves and are mountable to a supporting device of the suitcase at one end and insertable through the first and second receiving portions at an opposite end, wherein the locking plate is adapted to engage with the grooves of the engaging member.

10. The luggage compression panel of claim 9, wherein the supporting device of the suitcase is a suitcase chassis.

11. A suitcase, comprising:

a base portion forming a first outer shell portion and defining an interior space;

a single luggage compression panel having a bottom side and a top side opposite the bottom side disposed in the base portion of the suitcase for compressing items in the interior space, the single luggage compression panel comprising:

a flexible fabric;

a first locking mechanism disposed at a first end of the single luggage compression panel; and a second locking mechanism disposed at a second end of the single luggage compression panel opposite the first end;

a first engaging member mounted in the base portion and adapted to be coupled to the first locking mechanism of the single luggage compression panel; and a second engaging member mounted in the base portion and adapted to be coupled to the second locking mechanism of the single luggage compression panel, wherein the first engaging member is insertable through a first receiving portion of the first locking mechanism and through the single luggage compression panel, wherein the second engaging member is insertable through a second receiving portion of the second locking mechanism and through the single luggage compression panel, wherein the first and second receiving portions each comprise an aperture through which the first and second engaging members extend, the aperture disposed between the bottom side and the top side of the single luggage compression panel, wherein the first and second locking mechanisms allow movement in a locked configuration of the single luggage compression panel only in one direction in order to compress and retain the items, and wherein the first and second engaging members comprise a toothed portion.

12. The suitcase of claim 11, wherein the first and second engaging members comprise engaging recesses.

13. The suitcase of claim 11, further comprising a supporting device mounted on the base portion, wherein the first and second engaging members are mounted on the supporting device.

14. The suitcase of claim 13, wherein the supporting device comprises a rigid pan portion for stiffening the base portion, wherein the first engaging member is mounted on the rigid pan portion.

15. The suitcase of claim 14, wherein the rigid pan portion is in a mounting area of wheels.

16. The suitcase of claim 13, wherein the supporting device further comprises a handle reinforcement portion for accommodating a telescopable handle of the suitcase, wherein the first engaging member is mounted on the handle reinforcement portion.

17. A carrying system, comprising:

a suitcase comprising:

a base portion defining an interior space for accommodating items to be transported, the base portion forming a first outer shell portion of the suitcase;

a first engaging member mounted in the base portion and adapted to be coupled to a luggage compression panel;

a second engaging member mounted in the base portion and adapted to be coupled to the luggage compression panel;

a supporting device disposed on the base portion, wherein the first and second engaging members are disposed on the supporting device; and a single luggage compression panel for compressing items accommodated in the interior space of the suitcase, the single luggage compression panel comprising:

a supporting structure defining a supporting area, a first locking mechanism integral with a first end of the supporting structure for releasably fixing the first engaging member of the suitcase, and a second locking mechanism integral with a second end of the supporting structure, opposite the first end, for releasably fixing the second engaging member of the suitcase, wherein the first engaging member is insertable through a first receiving portion of the first locking mechanism, wherein the second engaging member is insertable through a second receiving portion of the second locking mechanism, wherein the supporting structure comprises:

a rigid frame integral with the first and second receiving portions of the first and second locking mechanisms and defining an outer boundary of the supporting structure; and a flexible fabric coupled to the rigid frame and extending within the outer boundary, and wherein the first and second receiving portions each comprise a loop coupled to the rigid frame, wherein the first and second engaging members extend through the loops within an outer perimeter of the single luggage compression panel, wherein the first and second locking mechanisms allow movement in a locked configuration of the single luggage compression panel only in one direction in order to compress and retain the items, and wherein the first and second engaging members comprise a toothed portion.

18. A single luggage compression panel for compressing items in an interior space of a suitcase, the single luggage compression panel comprising:

a supporting structure defining a supporting area and comprising a flexible fabric;

a first locking mechanism integrated with a first end of the supporting structure for releasably securing a first strap of the suitcase; and a second locking mechanism integrated with a second end of the supporting structure, opposite the first end, for releasably securing a second strap of the suitcase, wherein the first strap is insertable into a first receiving portion of the first locking mechanism and through the single luggage compression panel, wherein the second strap is insertable into a second receiving portion of the second locking mechanism and through the single luggage compression panel, wherein the single luggage compression panel is disposed in a base portion of the suitcase, wherein the first and second straps extend through the first and second receiving portions within an outer perimeter of the single luggage compression panel, and wherein the first and second locking mechanisms adjustably grip the first and second straps along the first and second straps to position the single luggage compression panel at different heights relative to the items.

19. The single luggage compression panel claim 18, wherein the supporting structure comprises a frame defining an outer boundary of the supporting structure.

20. The single luggage compression panel claim 19, wherein the supporting structure comprises a zipper disposed within the outer boundary of the frame.

* * * * *